US007114782B2

(12) United States Patent
Ambasz

(10) Patent No.: US 7,114,782 B2
(45) Date of Patent: Oct. 3, 2006

(54) FLEXIBLE CHAIR WITH STIFFENER INSERTS AND METHOD FOR FORMING A CHAIR

(75) Inventor: Emilio Ambasz, Buenos Aires (AR)

(73) Assignee: Center for Design Research and Development N.V., Curacao (AN)

( * ) Notice: Subject to any disclaimer, the term of this patent is extended or adjusted under 35 U.S.C. 154(b) by 0 days.

(21) Appl. No.: 10/855,116

(22) Filed: May 26, 2004

(65) Prior Publication Data

US 2005/0264083 A1 Dec. 1, 2005

(51) Int. Cl.
*A47C 3/04* (2006.01)
*A47C 7/02* (2006.01)

(52) U.S. Cl. ..... 297/452.2; 297/452.18; 297/452.19; 297/448.2; 297/239; 297/463.1; 297/463.2

(58) Field of Classification Search ..... 297/239, 297/452.2, 452.19, 452.18, 448.2, 463.1, 297/463.2
See application file for complete search history.

(56) References Cited

U.S. PATENT DOCUMENTS 1,960,022 A 5/1934 Melder
2,020,028 A * 11/1935 Hanuaer ..... 297/448.2 X
D149,982 S 6/1948 Sundberg
D202,775 S * 11/1965 Rowland ..... 297/239 X
3,278,227 A * 10/1966 Rowland ..... 297/239
3,404,916 A * 10/1968 Rowland ..... 297/239
3,446,530 A * 5/1969 Rowland ..... 297/239
3,594,041 A 7/1971 Rye
3,697,130 A * 10/1972 Barecki et al. ..... 297/239 X
3,724,897 A * 4/1973 Faiks et al. ..... 297/239 X
3,734,561 A * 5/1973 Barecki et al. ..... 297/239
3,815,955 A * 6/1974 Gibilterra ..... 297/448.2 X
3,826,453 A * 7/1974 Hitchcock ..... 297/239 X
3,847,433 A * 11/1974 Acton et al. ..... 297/239
3,971,592 A * 7/1976 Farley ..... 297/448.2
3,985,460 A * 10/1976 Piper et al. ..... 297/452.2 X
4,097,089 A 6/1978 Petersen
D248,432 S 7/1978 Petersen
4,131,315 A 12/1978 Vogtherr
4,265,483 A * 5/1981 Raftery et al. ..... 297/448.2 X
4,305,617 A * 12/1981 Benoit ..... 297/448.2
4,456,301 A * 6/1984 Apissomian ..... 297/448.2
4,518,202 A * 5/1985 Bitsch ..... 297/452.2
4,522,444 A 6/1985 Pollock (Continued)

FOREIGN PATENT DOCUMENTS

DE 41 35 488 4/1993

(Continued)

*Primary Examiner*—Rodney B. White
(74) *Attorney, Agent, or Firm*—Kenyon & Kenyon

(57) ABSTRACT

A chair includes: a hollow frame including, on each lateral side of the chair, a front, a back, a bottom, a front bend arranged between the front and the bottom, and a back bend arranged between the back and the bottom; a seat attached to the front of the frame; a seat back attached to the back of the frame; at least one front stiffener insert arranged inside the frame at the front bend and extending along a partial length of the front and the bottom; and at least one back stiffener insert arranged inside the frame at the back bend and extending along a partial length of the back and the bottom. The front stiffener inserts and the back stiffener inserts stiffen the frame relative to a frame without such inserts. The seat back and the seat may be movable independently of each other relative to the bottom of the frame.

29 Claims, 6 Drawing Sheets

U.S. PATENT DOCUMENTS 4,648,653 A * 3/1987 Rowland ..... 297/239
4,674,795 A 6/1987 Nelson
4,852,944 A * 8/1989 Hartmann ..... 297/239 X
5,064,247 A * 11/1991 Clark et al. ..... 297/447.3
5,110,186 A * 5/1992 Clark et al. ..... 297/448.2 X
5,114,212 A 5/1992 Verney et al.
5,308,147 A * 5/1994 Tseng ..... 297/452.18
5,383,712 A * 1/1995 Perry ..... 297/448.2
5,626,394 A * 5/1997 Perry ..... 297/448.2
5,806,931 A * 9/1998 Kogai ..... 297/452.2 X
RE36,335 E * 10/1999 Perry ..... 297/448.2
5,997,094 A * 12/1999 Cvek ..... 297/239 X
6,003,948 A * 12/1999 Holbrook ..... 297/448.2 X
6,382,223 B1 * 5/2002 Lah ..... 403/11 X
6,402,581 B1 * 6/2002 Podgaiz ..... 403/174 X
6,634,717 B1 10/2003 Kown

FOREIGN PATENT DOCUMENTS

EP 0 279 055 12/1987

* cited by examiner

FLEXIBLE CHAIR WITH STIFFENER INSERTS AND METHOD FOR FORMING A CHAIR

FIELD OF THE INVENTION

The present invention relates generally to a chair and a method for forming a chair. More particularly, the present invention relates to a chair which allows a predetermined amount of deflection of a chair frame when a person sits in the chair, based upon stiffener inserts placed inside the frame.

BACKGROUND INFORMATION

Many individuals who use chairs for long periods do not prefer to sit in a totally stiff chair. In response to this, manufacturers have produced adjustable chairs which provide individuals who use them with an added degree of comfort compared to stiff non-adjustable chairs. To accommodate these individuals, the adjustable chairs have numerous fine tuning adjustments. The adjustments can include devices for varying a height of the seating surface, varying the position of a seat back or adjusting the tension spring on a seat back for more or less support when an individual reclines.

Chairs which use these current seating designs may have to be constantly readjusted to allow an individual to position him/herself to a desired position. This may require a user to dismount the chair and fine tune the chair position to a desired configuration. This fine tuning may lead to further discomfort, and can impact the stability of the chair. As a result, the user must fine tune the chair again to a new setting to overcome these shortcomings. Over time, these chair settings may vary, requiring the user to again reset the chair to a desired configuration. As there is a constant need to fine tune the chair components, most users ignore the shortcomings of the chair configurations and merely use the chair in a non-optimal configuration. Such use in a non-optimal configuration can lead to significant problems such as worker fatigue and/or medical problems.

Another significant drawback of certain chair designs is that production of chairs which have numerous fine tuning adjustments is a complex procedure, increasing the overall production time and cost of the chair. Moreover, chairs which have numerous parts are more prone to fail, decreasing the overall service life.

Certain conventional chairs are believed to have a seat and a seat back that are positionally affixed to each other by connecting frame elements and that are cantilevered relative to a bottom support portion of a frame so that the seat and seat back are constrained to move in unison with each other relative to the bottom support portion of the frame, i.e., to the floor. Due to, e.g., ergonomics, user comfort, etc., there is believed to be a need for a chair in which the seat back and the seat are movable independently of each other relative to supporting frame members and to the floor.

There is believed to be a need for a chair which may provide a user with a supportive seating surface, but which remains flexible when a user shifts position, such as when the user rests against a chair back. There is also believed to be a need to maintain the amount of flexure for the chair such that a user may easily find a comfortable seated position.

There is believed to be a need for a chair design which may alleviate a user from having to continually finely adjust a chair position to maintain a comfortable configuration over time.

There is believed to be a further need to provide such a chair that may be inexpensive to manufacture and which may have a long service life.

SUMMARY

In an example embodiment of the present invention, a chair may provide a user with a supportive seating surface, which may remain flexible when a user shifts position, such as when the user rests against a chair back.

In an example embodiment of the present invention, a chair design may alleviate a user from having to continually finely adjust a chair's components while maintaining a comfortable seating position.

An example embodiment of the present invention may provide a durable chair that is inexpensive to manufacture.

In an example embodiment of a chair according to the present invention, the chair includes a support, a seat attached to the support, a frame attached to the support, the frame having a front, a bottom, and a back, and a seat back connected to the frame. The frame further has at least one front stiffener insert and at least one back stiffener insert, the front inserts and the back inserts configured to structurally stiffen the frame relative to a frame without inserts. The structural stiffening may be configured to provide a predetermined amount of flexibility of the front and/or back relative to each other and/or relative to the bottom and may provide such flexibility of the front independently of the back and vice versa.

In an example embodiment of the present invention, a chair includes: a hollow frame including, on each lateral side of the chair, a front, a back, a bottom, a front bend arranged between the front and the bottom, and a back bend arranged between the back and the bottom; a seat attached to the front of the frame; a seat back attached to the back of the frame; at least one front stiffener insert arranged inside the frame at the front bend and extending along a partial length of the front and the bottom; and at least one back stiffener insert arranged inside the frame at the back bend and extending along a partial length of the back and the bottom.

The frame may be tubular.

The chair may include an arm rest connected to the frame, and the chair may include a grip arranged on an exterior of the arm rest. The grip may be ribbed. The grip may be made of rubber.

The chair may include glides arranged on the bottom of the frame and configured to provide a contact surface for the chair to a floor. The glides may include a slip resistant surface to contact the floor.

The chair may include a support connected to the frame and configured to support the seat.

An inner diameter of the frame and an exterior diameter of the stiffener inserts may be substantially equal.

The frame may be made of a single member, which may include a tube.

The back of the frame and the front of the frame may be connected to each other only by the front bend, the bottom and the back bend.

The front stiffener inserts and back stiffener inserts may be substantially solid.

The front stiffener inserts and back stiffener inserts may be hollow tubes.

The back stiffener inserts may have an upright length greater than the front stiffener inserts.

The back stiffener inserts and the front stiffener inserts may extend in an upright direction an equal amount.

The front stiffener inserts and the back stiffener inserts may be configured to provide a predetermined degree of stiffness to the frame at the front bends and back bends.

The seat back and the seat may be movable independently of each other relative to the bottom of the frame.

In accordance with an example embodiment of the present invention, a chair includes: a hollow frame including, on each lateral side of the chair, a front, a back, a bottom, a front bend arranged between the front and the bottom, and a back bend arranged between the back and the bottom; a seat attached to the front of the frame; a seat back attached to the back of the frame; means for stiffening the frame at the front bend; and means for stiffening the frame at the back bend.

In accordance with an example embodiment of the present invention, a method for forming a chair includes: inserting a first stiffener insert into each of two hollow tubular members at a first location; inserting a second stiffener insert into each of two hollow tubular members at a second location; after the inserting steps, bending each tubular member and first stiffener insert in an area of the first location and bending each tubular member and second stiffener insert in an area of the second location to form a front, a bottom and a back of each lateral side of a frame of the chair; after the bending step, connecting a seat to the front of the frame; and after the bending step, connecting a seat back to the back of the frame.

DETAILED DESCRIPTION

Figure 1:
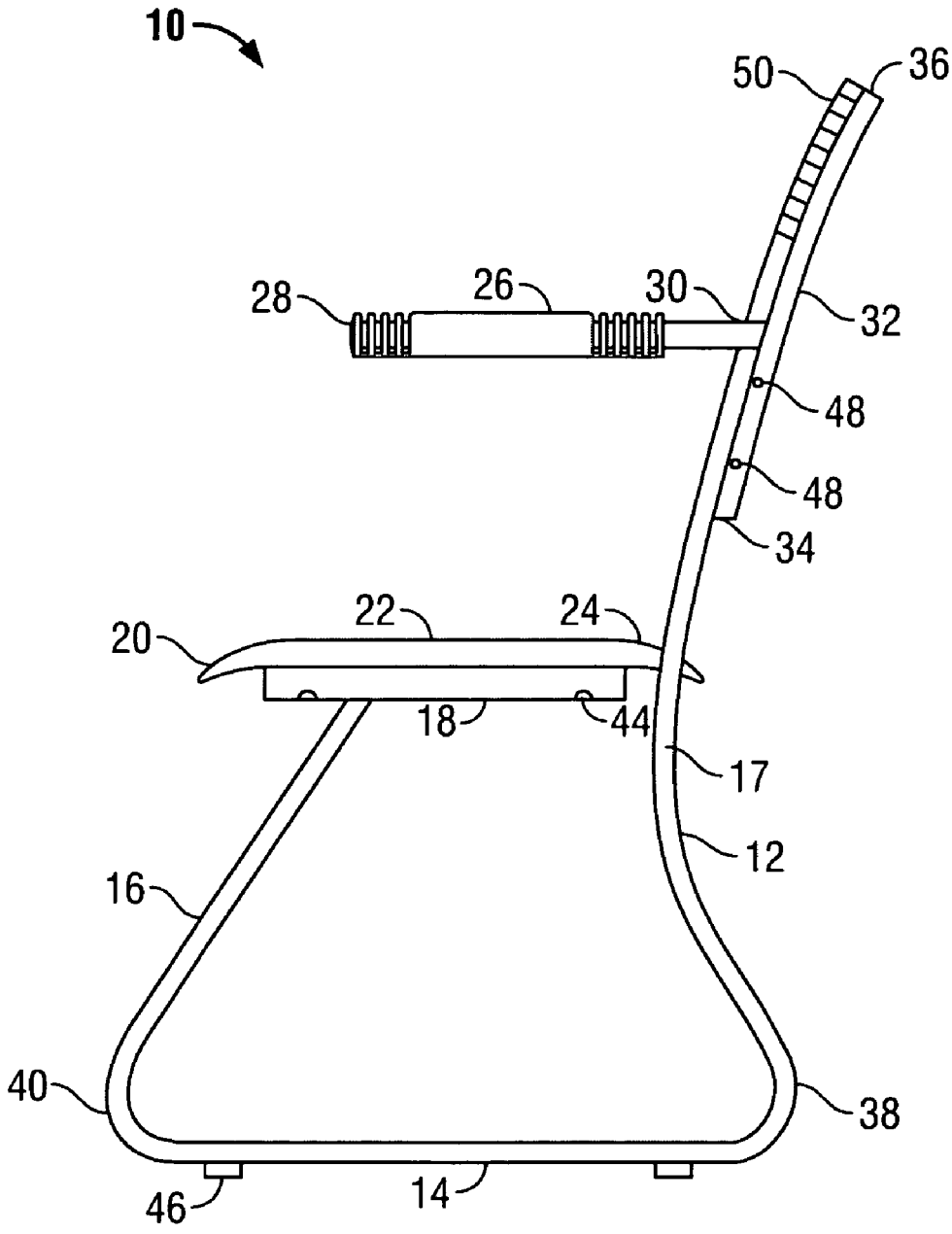
FIG. 1 is a side view of an example embodiment of a chair according to the present invention.

Referring to FIG. 1, a chair 10 of an example embodiment of the present invention is illustrated. The chair 10 has a frame 12 which is constructed from a member which has sufficient structural load carrying capacity to accommodate a seated individual. In the present embodiment, the frame 12 is configured from a hollow tube, e.g., a structural pipe. The frame 12 may also be configured from structural tube as an additional non-limiting configuration. On each lateral side of the chair 10, the frame 12 has a back 17, a bottom 14 and a front 16. The bottom 14 provides a contact surface which may be used to contact a flooring surface. The front 16 is connected to the bottom 14 a front bend 40. The front 16 is connected to a support 18. The front 16 may be angled with respect to the bottom 14 at a front bend 40 to extend back to the support 18. The angle between the bottom 14 and the front 16 at the front bend 40 may be varied thereby increasing or decreasing the overall seat height of the chair 10 and the inclination of the seat 22 relative to the floor and relative to the remaining components of the chair 10. As illustrated, the support 18 is connected to a seat 22. The support 18 is configured to support the weight of an intended user. The support 18 may be made of pipe, as illustrated, or may be constructed from other structural member shapes, such as channels for example. The support 18 may be cantilevered from a connection with the front 16 of the frame 12. An alternative embodiment allows the connection between the support 18 and the front 16 of the frame 12 to be centrally located to the support 18 such that cantilever spans extend in substantially equal distances from the connection point.

The back 17 of the frame 12 may be arched from a back bend 38 to the seat back top 36. The amount of arch between the back bend 38 and the seat back top 36 may be increased or decreased during fabrication of the chair 10. The amount of arch may be specified to provide greater or reduced lumbar support for a seated individual. The amount of arch may also allow the seat rear 24 to extend past the adjacent portion of the frame 12 such that little or no gap is present between the seat rear 24 and the frame 12 when an individual uses the chair 10. Alternatively, the back 17 of the frame 12 may be configured such that there is a gap between the seat rear 24 and the back 17 of the frame 12. The back 17 of the frame 12 is configured to structurally support the seated individual enough to allow the back 17 of the frame 12 to bend a prescribed amount. The amount of bend permitted is controlled such that discomfort of the individual is prevented. The back 17 of the frame 12 may also be a straight design between the back bend 38 and the seat back top 36. The seat 22 may be configured to move separately from the back 17 of the frame 12 and the seat back 32, thus the seat 22 may be geometrically configured to avoid contact with the frame 12 which would limit overall movement of the seat 22. The frame 12 may be configured from, e.g., aluminum pipe, steel, stainless steel, etc. The surface of the frame 12 may be highly polished.

The seat 22 provides a surface upon which a person may sit on the chair 10. The seat 22 is connected to the support 18 through seat connection 44. The seat 22 may be a preformed unit, made of plastic for example, or may be a composite structure. The seat 22 may be covered with a variety of materials, including cloth, leather, etc., to provide a durable and attractive surface for the user. Covers for the seat 22 if used, may be flame retardant and/or stain resistant. If the seat 22 is made of plastic, the surface of the seat 22 may be formed such that slip of the user is resisted, through, for example, texturing the plastic seating surface. The seat 22 is configured with a seat front 20 and a seat rear 24. The relative positions of the seat front 20 and the seat rear 24 may be altered such that the seating position of the individual may be moved forward or backward relative to the seat back 32. In the configuration illustrated, the seat rear 24 may be positioned such that an overlap of the seating surface and the seat back surface occurs. The seat front 20 and/or the seat rear 24 may be configured such that the ends are blunt to prevent binding when a users body parts contacts these edges. As illustrated, the seat front 20 and seat rear 24 may be sloped to additionally protect the user from a sharp contact point.

The seat 22 is configured such that the seat 22 may be moved independently of the seat back 32 relative to the bottom 14 of the frame 12, i.e., and to the floor. For example, the seat 22 may move independently from the seat back 32 such that when a user leans back onto the seat back 32, the user may force the seat 22 to move in a forward direction (i.e., a direction away from the seat back 32) when relaxing.

The seat connection 44 may include mechanical arrangements, such as screws, bolts, other arrangements, etc., for example. Other mechanical arrangements may also be used such as rivets or welds. If the seat connection 44 is provided through a screw or bolt, for example, the screw or bolt may be countersunk into the seat connection 44 to limit the possibility of contact between the user and any potentially sharp components of the connection 44. The seat connection 44 may also be configured to allow for snap insertion of the seat 22 onto the support 18, thereby allowing the seat 22 to be easily removable.

An arm rest 28 is connected to the back of the frame 12, allowing the user to place an arm on the chair 10. The connection 30 of the arm rest 28 to the frame 12 may be through a welded, bolted or other connection, etc. The arm rest 28 is cantilevered from the back of the frame 12 to provide a clear span under the length of the arm rest 28 allowing greater space for the user on the sides of the chair 10. The arm rest 28 may be made of a pipe member as illustrated, for example, to provide sufficient structural support. Other structural members may be used, including channels, tubes, etc., as non-limiting examples. In the illustrated example embodiment, the arm rest 28 may be arranged substantially parallel to the seat 22 and the bottom 14 of the frame 12. The arm rest 28 may be attached such that the arm rest 28 is placed in a non-parallel configuration to either the seat 22 and/or the bottom 14 of the frame 12.

The arm rest 28 is provided with a grip 26. The grip 26 may extend down the entire length of the arm rest 28 or may be positioned along any portion of the arm rest 28. The grip 26 may be configured such that a comfortable positioning of a users arm is encouraged along the arm rest 28. The grip 26 may be configured with individual ribs, as illustrated. If configured with ribs, the ribs may be positioned along the entire grip 26 or along sections of the grip 26. The grip 26 may be made of high density plastic, as another non-limiting example. The grip 26 may also be made of rubber for user comfort. The grip 26 can also be configured as a pair of arm pads connected to the arm rest 28.

The frame 12 extends from a back bend 38 to a top 36. A seat back 32 is positioned on the frame 12 to provide a user with a surface to support the back of an individual when the individual assumes a seated position. The seat back 32 extends from a back bottom 34 to a back top 36. The seat back 32 may be lengthened or shortened to provide a larger or smaller supporting surface.

The seat back 32 is connected to the frame 12 through a back connection 48. The back connection 48 may be established through bolts, screws, other mechanical connections, etc. The back connection 48 may be optionally covered to conceal any sections of the connection 48. The back connection 48 may also be established by sliding the seat back 32 into channels in the frame 12. The seat back 32 may be configured with ribs 50 so that a textured surface contacts the seated individual.

The frame 12 is configured with a back bend 38 and a front bend 40. A set of glides 46 are positioned on the bottom 14 between the back bends 38 and the front bends 40. The set of glides 46 provides a contact surface between the chair 10 and the flooring surface. The set of glides 46 may be configured with a slip resistant bottom surface to prevent and/or limit the chair 10 from sliding upon the supporting surface. The set of glides 46 may be attached to the bottom through either a chemical connection, such as gluing, etc., or a mechanical connection, such as a machine screw, etc. The glides 46 may also be configured such that they are adjustable so that a height of the chair may be raised or lowered. The set of glides 46 may be replaced by casters to allow for the chair 10 to roll along the floor surface. The casters may be attached to the chair 10 through inserts placed in the bottom 14.

Figure 2:
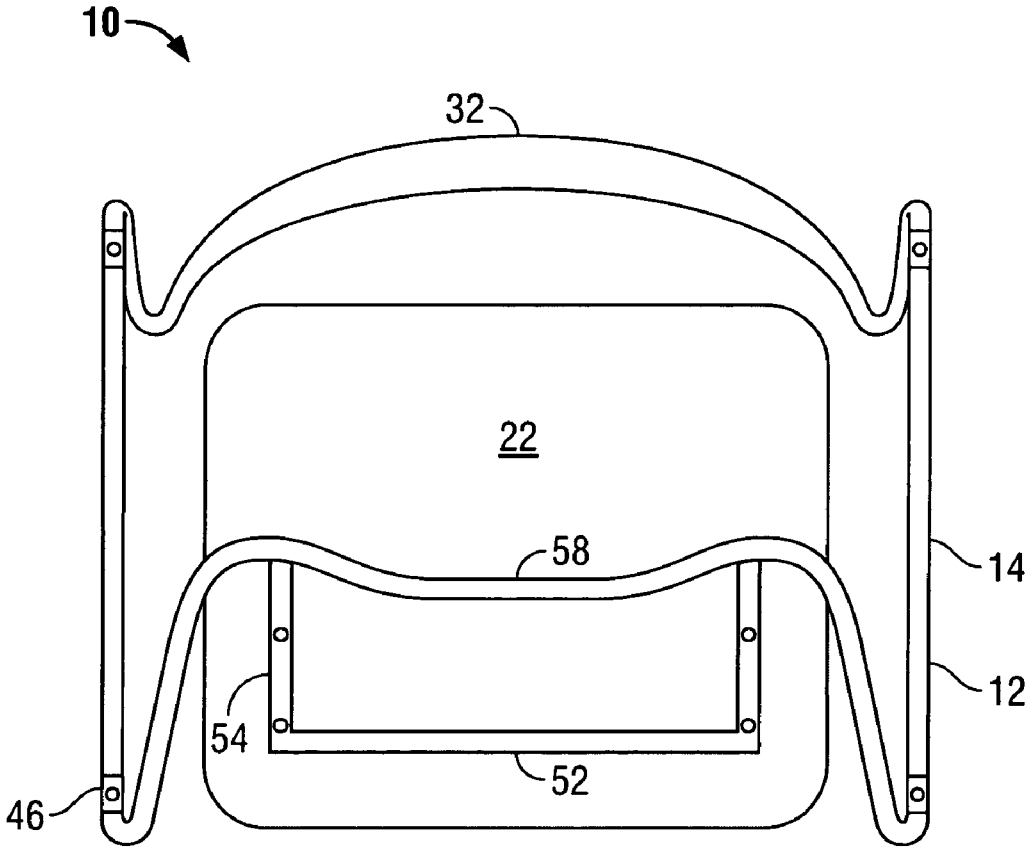
FIG. 2 is a bottom view of the chair of FIG. 1.

FIG. 2 illustrates a bottom view of the chair 10 illustrated in FIG. 1. The seat 22 is supported by a lower support 52 connected to a side support 54. The lower support 52 is connected to a seat support member 58. The seat support member 58 may be formed as part of the frame 12, as illustrated, or may be a separate member. The surfaces of the seat support member 58, the side support 54 and the lower support 52 contacting the lower surface of the seat 22 may fully contact the seat 22 along the full length of the respective members. Alternatively, selected spots of the respective members may contact to provide support for the seat 22.

Figure 3:
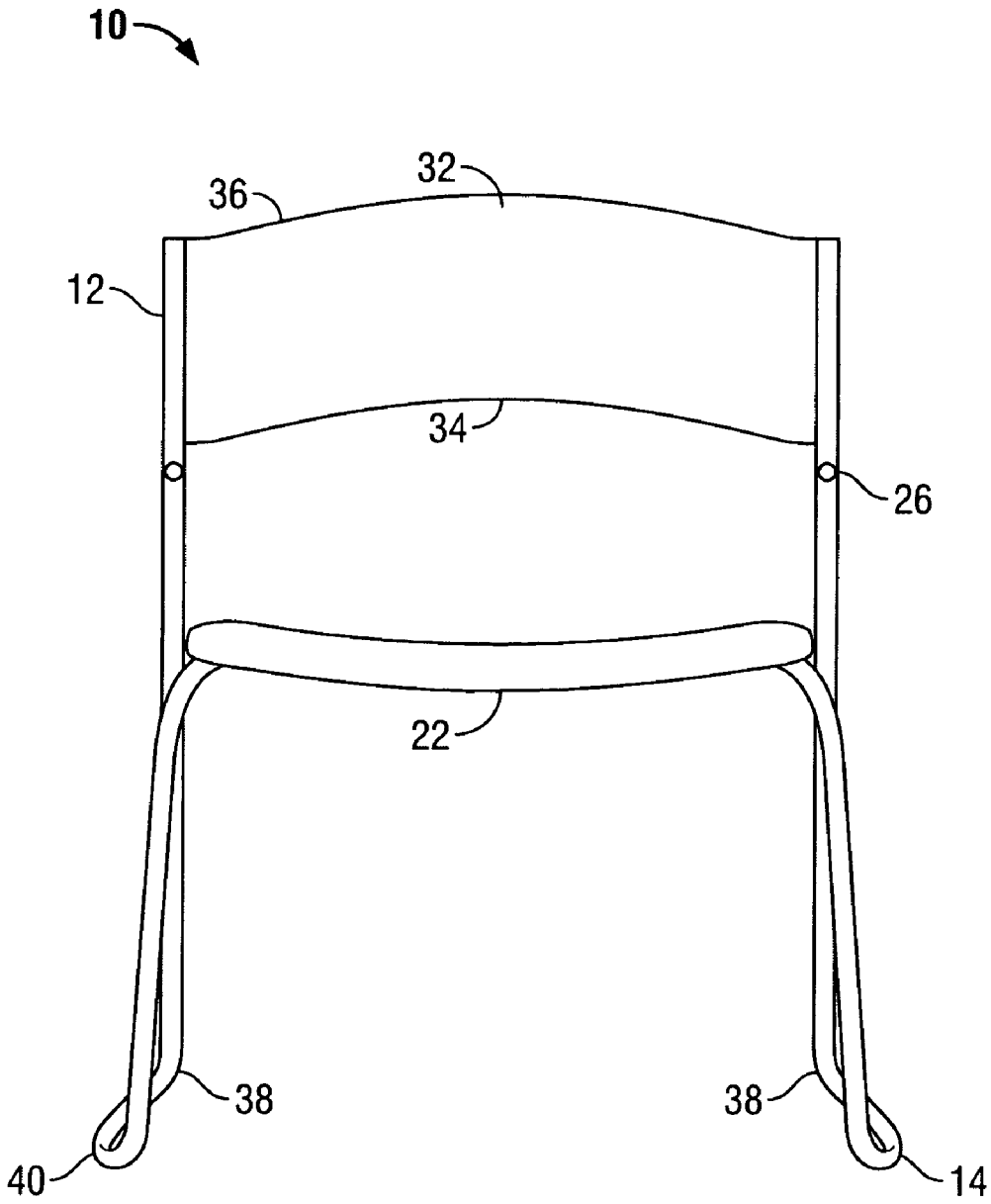
FIG. 3 is a front view of the chair of FIG. 1.

FIG. 3 is a front view of the chair 10. The seat back 32 of the chair 10 may be arched such that the upper edge of the seat back 32 is raised in relation to the ends of the seat back 32 which connect with the frame 12. The back bottom 34 may also be arched such that the ends of the bottom 34, which connect to the chair 10, are lower than the center of the bottom 34. The frame 12 may be configured such that the front bend 40 portion of the frame 12 flares outwardly as compared to the back of the frame 12.

Figure 4:
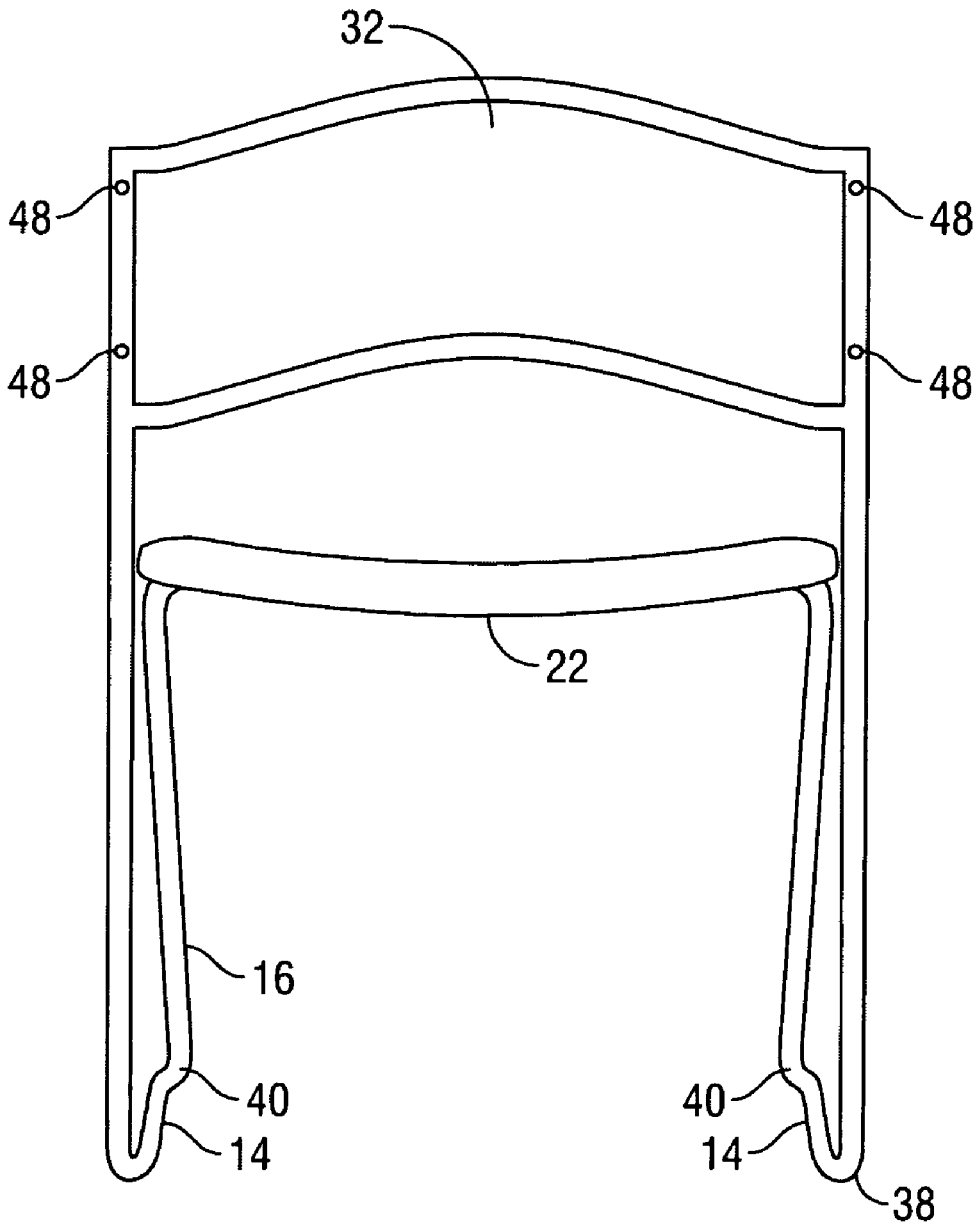
FIG. 4 is a back view of the chair of FIG. 1.

Referring to FIG. 4, a back view of the chair 10 is illustrated. The seat back 32 is connected to the frame 12 through back connections 48. Any number of connections may be used to secure the seat back 32 to the frame. The connection 48 may be countersunk into the seat back 32 such that the connections 48 do not protrude past an exterior of the seat back 32. A back bend 38 is positioned on one end of the bottom 14 of the frame 12. The seat back 32 may be configured with an additional lumbar support for a seated individual.

Figure 5:
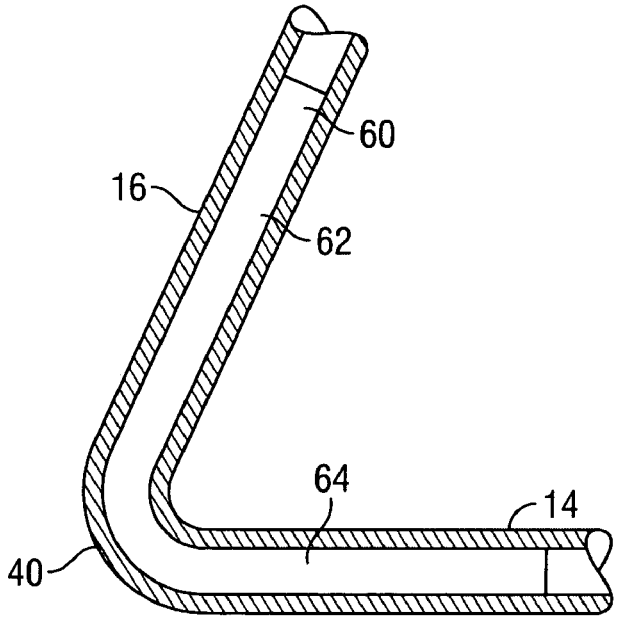
FIG. 5 is a cut-away section of a front stiffener insert of a frame.

FIG. 5 illustrates the front bend 40 of the frame 12. A front stiffener insert 60 may be placed in the front bend 40 such that the relative stiffness of the frame 12 is enhanced compared to a non-stiffened frame. The front stiffener insert 60 may have an external diameter which snugly fits into the internal diameter of the front bend 40. The front stiffener insert 60 may be inserted into the frame 12 before the creation of any bends in the frame, thereby allowing insertion of the front stiffener insert 60 prior to forming a final bent frame structure. The front stiffener insert 60 may be made of any material which provides a stiffer frame when the stiffener insert is positioned in the frame and which provides the desired degree of stiffening. The front stiffener insert 60 may be made of a material which has a relative stiffness greater than the stiffness of the frame 12 into which the stiffener insert 60 is placed. The front stiffener insert 60 may extend any desired length in an upright 62 or horizontal 64 direction, to provide stiffness. The front stiffener insert 60 may have a length in accordance with a desired degree of stiffness or flexibility. The front stiffener insert 60 may be a solid or hollow unit providing a greater of lesser degree of structural stiffness to the frame 12.

Figure 6:
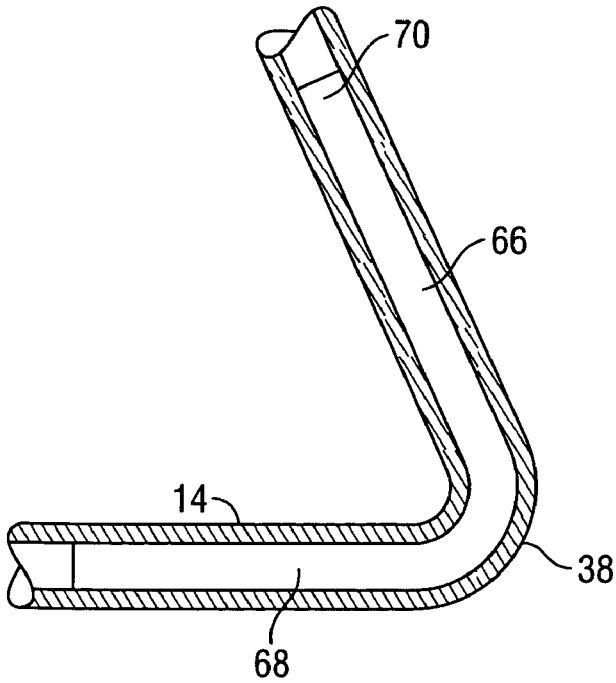
FIG. 6 is a cut-away section of a back stiffener insert of a frame.

FIG. 6 is a partial cut-away cross section of the frame 12 in an area of the back bend 38. A rear stiffener insert 70 is placed in the frame 12 such that it extends from the back of the frame 12 to the bottom 14. The rear stiffener insert 70 may be configured such that it has a definable horizontal length 68 and an upright length 66. The rear stiffener insert 70 may have an external perimeter or circumference which allows the stiffener insert 70 to be snugly placed in the frame 12. The rear stiffener insert 70 may be made of any material which would allow a stiffer frame when the stiffener insert 70 is positioned in the frame 12. The rear stiffener insert 70 may be made of a material which has a relative stiffness greater than the stiffness of the frame 12 into which the stiffener insert 70 is placed. The rear stiffener insert 70 may extend any desired length in an upright 66 or horizontal 68 direction, to provide stiffness. The stiffener insert 70 may be a solid or hollow unit providing a greater of lesser degree of structural stiffness to the frame 12. Thus, the rear stiffener insert, by selection of length, height, material properties, etc., may provide a predetermined degree of stiffness or flexibility for the seat back 32 of chair 10.

Figure 7:
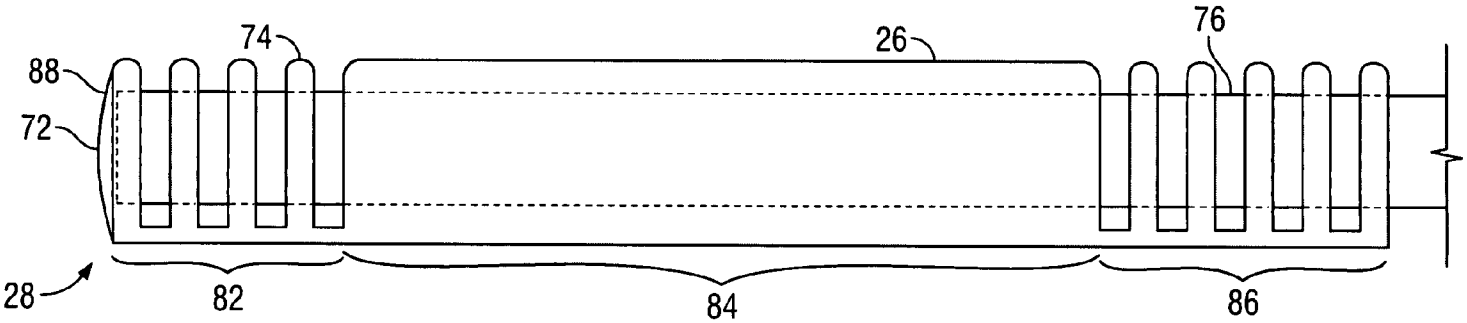
FIG. 7 is a detailed view of an arm rest grip.

FIG. 7 is a side view of the grip 2 of the chair 10. The grip 26 may be formed with an exterior end 72 which may be inserted onto the frame portion of the armrest 28. The grip 26 is configured such that the grip 26 will not rotate or slide along the frame portion of the armrest 28. The grip 26 may be formed into a first section 82, a second section 84 and a third section 86. The first section 82 is configured with a set of ribs 74 which are separated by spaces 76. The second section 84 is configured with a solid exterior body. The third section 86 is configured with a second set of ribs. An end cap 88 may be formed on the grip 26 such that the frame portion of the armrest 28 contacts the grip 26 to limit further travel. The grip 26 may also be configured as a solid piece, or entirely of ribs.

Figure 8:
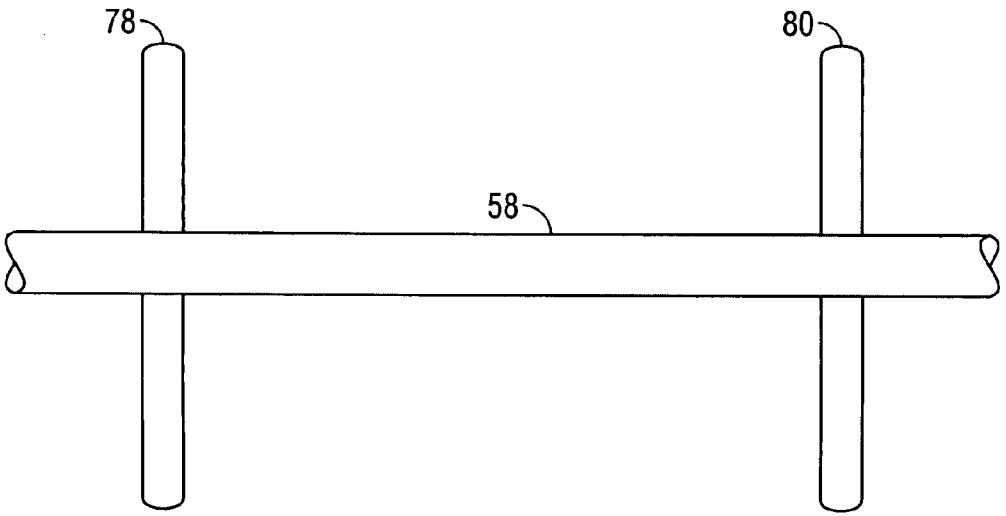
FIG. 8 is a bottom view of an example embodiment of a support for a seat.

FIG. 8 illustrates an example embodiment of the support structure underneath the seat 22 of the chair 10. The seat support member 58 may have a first member 78 and a second member 80 positioned such that the bottom of the seat 22 is supported only by the first member 78 and the second member 80. The first and second members 78, 80 may extend over the seat support member 58 such that the first and second members 78, 80 have substantially equal support lengths over a center line of the seat support member.

The chair 10 may have a supportive seating surface, while remaining flexible to allow a user to shift position, such as when the user reclines toward a back of the chair 10. The chair 10 may also provide a design which alleviates a user from having to continually finely adjust a chair while maintaining a comfortable seating position. The chair 10 may be easily manufactured due to minimization of moving parts. The minimization of moving parts may also decrease the cost to produce the chair.

It should be appreciated from the foregoing description that the seat 22 and the seat back 32 may be moved, e.g., flexed from a rest position due to the flexibility, stiffness and resiliency characteristics of the frame 12, independently of each other relative to the bottom 14 of the frame 12, and to the floor.

The chair 10 may be formed according to a method, which includes inserting the front stiffener insert 60 into each of two hollow tubular members at a location that will be bent to form the front bend 40 and inserting the back stiffener insert 70 into each of the two hollow tubular members at a location that will be bent to become the back bend 38. After insertion, each tubular member and first stiffener insert 60 is bent and each tubular member and second stiffener insert 70 is bent to form the front 16, the bottom 14 and the back 17 of each lateral side of the frame 12 of the chair 10, with front bend 40 and back bend 38 being formed respectively between the front 16 and the bottom 14 and between the back 17 and the bottom 14. After bending, the seat 22 is connected to the front 16 of the frame 12, and the seat back 32 is connected to the back 17 of the frame 12.

What is claimed is:

1. A chair, comprising:

a hollow frame including, on each lateral side of the chair, a front, a back, a bottom, a front bend arranged between the front and the bottom, and a back bend arranged between the back and the bottom;

a seat attached to the front of the frame;

a seat back attached to the back of the frame;

at least one front stiffener insert arranged inside the frame at the front bend and extending along a partial length of the front and the bottom; and at least one back stiffener insert arranged inside the frame at the back bend and extending along a partial length of the back and the bottom;

wherein the back of the frame and the front of the frame are connected to each other only by the front bend, the bottom and the back bend.

2. The chair according to claim 1, wherein the frame is tubular.

3. The chair according to claim 1, further comprising an arm rest connected to the frame.

4. The chair according to claim 3, further comprising a grip arranged on an exterior of the arm rest.

5. The chair according to claim 4, wherein the grip is ribbed.

6. The chair according to claim 4, wherein the grip is made of rubber.

7. The chair according to claim 1, further comprising glides arranged on the bottom of the frame and configured to provide a contact surface for the chair to a floor.

8. The chair according to claim 7, wherein the glides include a slip resistant surface to contact the floor.

9. The chair according to claim 1, further comprising a support connected to the frame configured to support the seat.

10. The chair according to claim 1, wherein an inner diameter of the frame and an exterior diameter of the stiffener inserts are substantially equal.

11. The chair according to claim 1, wherein the frame is made of a single unitary one-piece member.

12. The chair according to claim 11, wherein the member includes a tube.

13. The chair according to claim 1, wherein the front stiffener inserts and back stiffener inserts are substantially solid.

14. The chair according to claim 1, wherein the front stiffener inserts and back stiffener inserts include hollow tubes.

15. A chair, comprising:

a hollow frame including, on each lateral side of the chair, a front, a back, a bottom, a front bend arranged between the front and the bottom, and a back bend arranged between the back and the bottom;

a seat attached to the front of the frame;

a seat back attached to the back of the frame;

at least one front stiffener insert arranged inside the frame at the front bend and extending along a partial length of the front and the bottom; and at least one back stiffener insert arranged inside the frame at the back bend and extending along a partial length of the back and the bottom;

wherein the back stiffener inserts have an upright length greater than the front stiffener inserts; and wherein the back of the frame and the front of the frame are connected to each other only by the front bend, the bottom and the back bend.

16. The chair according to claim 1, wherein the back stiffener inserts and the front stiffener inserts extend in an upright direction an equal amount.

17. The chair according to claim 1, wherein the front stiffener inserts and the back stiffener inserts are configured to provide a predetermined degree of stiffness to the frame at the front bends and back bends.

18. The chair according to claim 1, wherein the seat back and the seat are movable independently of each other relative to the bottom of the frame.

19. A chair, comprising:

a hollow frame including, on each lateral side of the chair, a front, a back, a bottom, a front bend arranged between the front and the bottom, and a back bend arranged between the back and the bottom;

a seat attached to the front of the frame, a seat back attached to the back of the frame, stiffening means inserted inside the frame at the front bend; and stiffening means inserted inside the frame at the back bend;

wherein the back of the frame and the front of the frame are connected to each other only by the front bend, the bottom and the back bend.

20. The method according to claim 19, wherein the means for stiffening the frame at the front bend spans the front bend between the front and the bottom.

21. The chair according to claim 20, wherein the means for stiffening the frame at the back bend spans the back bend between the back and the bottom.

22. The chair according to claim 19, wherein the means for stiffening the frame at the back bend spans the back bend between the back and the bottom.

23. A method for forming a chair, comprising:

inserting a first stiffener insert into each of two hollow tubular members at a first location;

inserting a second stiffener insert into each of two hollow tubular members at a second location;

after the inserting steps, bending each tubular member and first stiffener insert in an area of the first location and bending each tubular member and second stiffener insert in an area of the second location to form a front, a bottom and a back of each lateral side of a frame of the chair;

after the bending step, connecting a seat to the front of the frame; and after the bending step, connecting a seat back to the back of the frame;

wherein the back of the frame and the front of the frame are connected to each other only by the front bend, the bottom and the back bend.

24. The method according to claim 23, wherein the bending step includes forming a first bend in each tubular member at the first location, the first stiffener insert spanning the first bend between the front and the bottom.

25. The method according to claim 24, wherein the bending step includes forming a second bend in each tubular member at the second location, the second stiffener insert spanning the second bend between the back and the bottom.

26. The method according to claim 23, wherein the bending step includes forming a second bend in each tubular member at the second location, the second stiffener insert spanning the second bend between the back and the bottom.

27. The chair according to claim 1, wherein the front stiffener insert spans the front bend between the front and the bottom.

28. The chair according to claim 27, wherein the back stiffener insert spans the back bend between the back and the bottom.

29. The chair according to claim 1, wherein the back stiffener insert spans the back bend between the back and the bottom.

* * * * *